United States Patent [19]

Brandmaier et al.

[11] 4,328,657

[45] May 11, 1982

[54] AUTOMATIC CARD DISPENSER AND PICK-OFF ASSEMBLY

[75] Inventors: C. Edward Brandmaier, Centerport; Edmund G. Dennis, Belle Terre, both of N.Y.

[73] Assignee: Cashin Systems Corp., Hauppauge, N.Y.

[21] Appl. No.: 143,529

[22] Filed: Apr. 24, 1980

[51] Int. Cl.[3] ..... B65B 49/16; B65B 25/06

[52] U.S. Cl. ..... 53/586; 53/231; 53/251; 53/DIG. 1; 493/125; 493/418

[58] Field of Search ..... 53/466, 586, 228, 231, 53/251, 250, DIG. 1, 206, 377, 580, 593; 493/123–125, 418

[56] References Cited

U.S. PATENT DOCUMENTS

| | | | |
|---|---|---|---|
| 2,764,070 | 9/1956 | Fay et al. | 493/125 |
| 2,907,152 | 10/1959 | Hensgen et al. | 53/DIG. 1 |
| 3,405,504 | 10/1968 | Marshall et al. | 53/74 |
| 3,439,588 | 4/1969 | Taylor et al. | 493/125 X |
| 3,618,482 | 11/1971 | Bowman | 493/123 |
| 3,815,319 | 6/1974 | Vedvik | 53/DIG. 1 |

*Primary Examiner*—James F. Coan
*Attorney, Agent, or Firm*—Kane, Dalsimer, Kane, Sullivan and Kurucz

[57] ABSTRACT

A cardboard sheet dispenser is incorporated in a bacon or pork product slicing machine line that is operable to group slices in shingled fashion into segregated batches of predetermined weight. The dispenser directs a cardboard sheet in synchronized fashion with the movement of the batches so that individual batches are placed on a sheet and thereafter transferred to subsequent packaging stations. The dispenser includes a hopper for receiving vertically stacked cardboard sheets and is provided with a plurality of restrainers that cooperate in supporting the stack of sheets and at the same time fan the sheets to minimize sticking of the sheets one to the other. The base of the hopper includes a plurality of strippers also serving to support the stack of sheets and assures that only one sheet is removed from the base of the hopper at a time. A pick-off assembly including a pivotal piston-cylinder assembly operates to remove the lowermost sheet from the hopper and transfer the lowered sheet into the nip of a roller assembly. A second piston-cylinder assembly coupled with the first piston-cylinder assembly actuates the first assembly between a vertical upright position and an inclined position at which the sheet is picked up by the roller assembly. The roller assembly directs the cardboard sheet to a location at which it is adapted to be moved by a pusher assembly to a location where the sheet receives a batch of slices thereon. The cardboard sheet feeding cycle is commenced upon the retraction of this pusher assembly.

12 Claims, 12 Drawing Figures

AUTOMATIC CARD DISPENSER AND PICK-OFF ASSEMBLY

BACKGROUND OF THE INVENTION

Sliced bacon is normally packaged in a hermetically sealed plastic envelope, bearing suitable indicia identifying the product and packager or it may be placed in a cardboard sheet package having this information. In most instances, the bacon is sliced and arranged in shingle form and prior to sealing in the envelope a predetermined measure of segregated slices is placed on a cardboard sheet. In the past, the segregated group of slices were placed on the cardboard sheet manually by attendants located at the discharge end of the bacon slicing machine and prior to packaging of the bacon, or, more recently, most bacon lines have been equipped with an automatic cardboard sheet dispenser.

An automatic dispenser frequently used is the No. 1026 Cardboard Dispenser manufactured and marketed by The Allbright-Nell Company a division of Chemetron Corporation, Chicago, Ill. In a dispenser of this type, cardboard sheets are normally stacked in a magazine inclined relative to the horizontal. Pneumatically actuated suction cups take individual cardboard sheets from the magazine and place them between the nip of rollers which transfer each cardboard sheet under a chain conveyor on which is travelling segregated sliced bacon segregated in groups of predetermined measure or a predetermined weight i.e. one-half pound or one pound. A pusher under the conveyor is actuated by an electriceye which senses the presence of a segregated group of slices travelling on the conveyor and pushes a card at the trailing end of the chain conveyor. The travel of the card and the travel of the bacon package are timed such that the group will be deposited on the cardboard sheet.

The Marshall et al U.S. Pat. No. 3,405,504 granted Oct. 15, 1968 to Chemetron Corporation for Transferring System on an application filed Oct. 21, 1965 discloses such a dispenser. The conveying line consists of two sequential continuously operating conveyors. Shingled bacon units from the first conveyor are transferred onto the second conveyor. A magazine holding stacked cards is mounted on a support at one side of the conveying unit. A vacuum cup mounted on a pivoted arm which can reciprocate in two separate planes at right angles to each other transfers the cards one at a time from the magazine to a pair of feed rollers which feed the individual cards to a supporting platen beneath the first conveyor. From there, a pusher arm pushes the card forwardly to a pair of feed rollers which feed the card onto the leading edge of the second conveyor immediately beneath the sliced bacon unit as it transfers from the end of the first conveyor to the second conveyor. One of the feed rollers is the pulley at the leading end of the second conveyor so as to insure feeding the card at the same speed as the second conveyor. So as to time and control the device, a sensing unit is provided in the form of a light beam source at one side of the conveyor focused onto a mirror beneath the center of the conveyor which directs the light beam onto a photocell about the central portion of the conveyor so that the light beam is interrupted by a passing unit of sliced bacon. A safety device is provided to render the sensing device inactive if the beam is only interrupted for a minimum period of time as by a scrap of bacon.

There are a number of difficulties with prior art automatic cardboard sheet dispensers, as for example, the inability to handle and accommodate cardboard sheets of larger size and particularly the type of cardboard sheet, that, in essence, completely surrounds the sliced product. In addition, the prior art dispenser utilized an inclined magazine for storaging the cardboard sheets. A magazine of this type has severe limitations as to the number of cardboard sheets that it can store and also storage of cardboard sheets in this manner results in feeding problems of the cardboard sheets to the discharge station as they are removed from the magazine. In other words, the inclination of the magazine caused faulty feeding problems of the stacked cardboard sheets.

SUMMARY OF THE INVENTION

A principal object of the present invention is to eliminate the drawbacks of the prior art cardboard sheet dispensers by providing an improved cardboard sheet dispenser that has optimum stacking and dispensing capabilities of cardboard sheets within a magazine or hopper.

Another object is to provide an improved cardboard sheet dispenser of the foregoing type in which not only may larger cardboard sheets be handled by and stored in the hopper, but the number of cardboard sheets stacked in the hopper may be increased by at least a factor of two.

A further object is to provide an improved cardboard sheet dispenser of the foregoing type in which the individual cardboard sheets are transferred from the hopper to a station at which they may be conveyed in sequence with the travel of sliced bacon or other food product, without danger of the individual cardboard sheets being scattered throughout the machine location or otherwise thrown.

Other objects and advantages will become apparent from the following detailed description which is to be taken in conjunction with the accompanying drawings.

DETAILED DESCRIPTION OF THE PREFERRED EMBODIMENT

Figure 1:
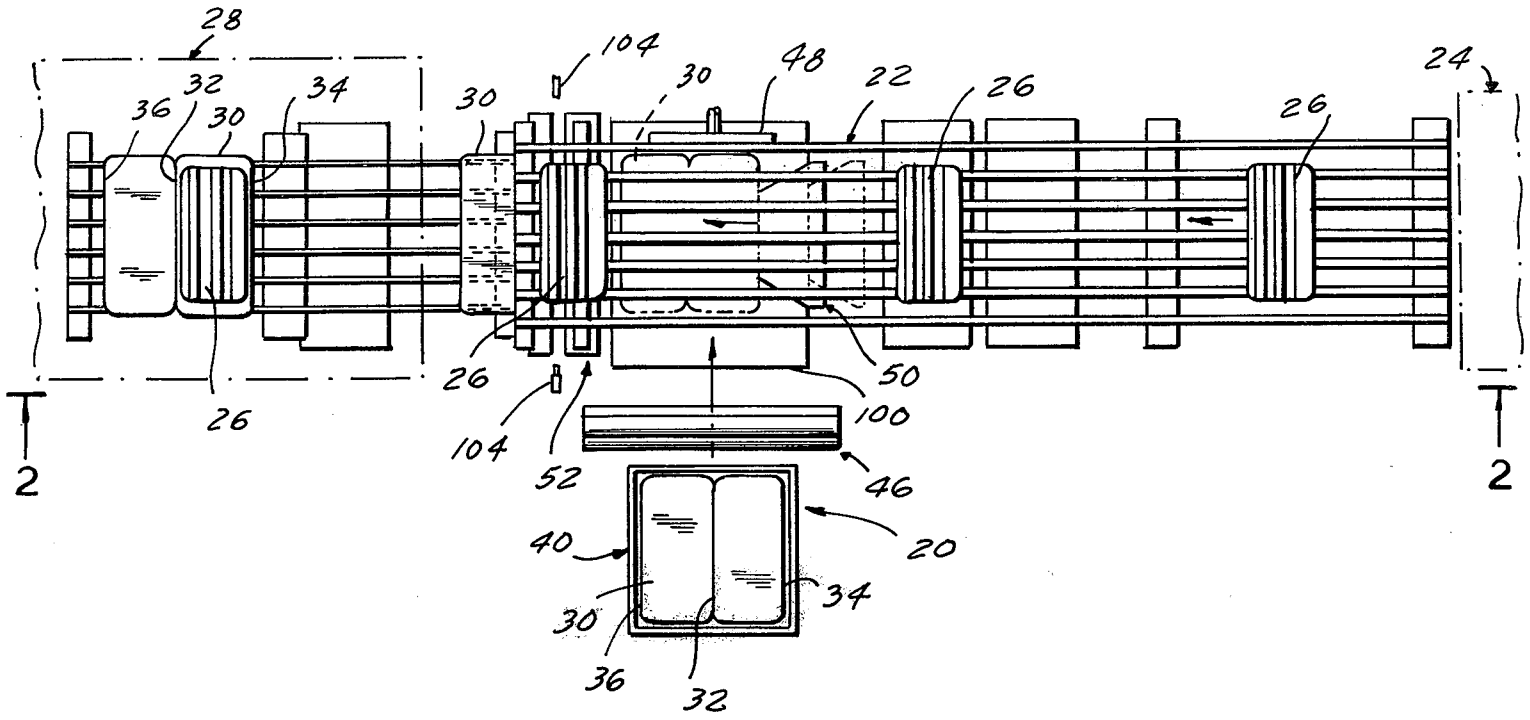
FIG. 1 is a schematic top plan view of an automatic cardboard sheet dispenser incorporating the teachings of this invention associated with a bacon slicing line in which segregated batches of sliced bacon are placed on the dispensed cardboard sheet and conveyed to subsequent stations to complete the packaging of the product.
Figure 2:
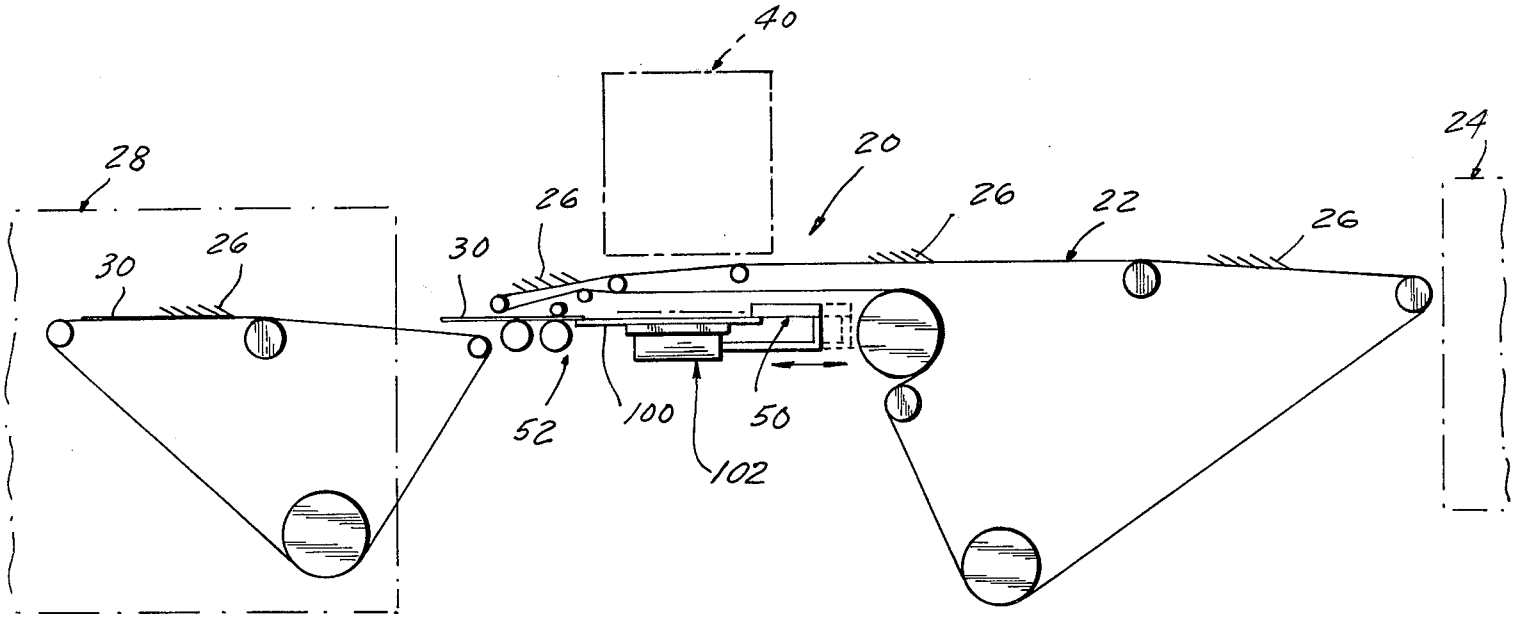
FIG. 2 is a schematic side elevational view thereof.
Figure 3:
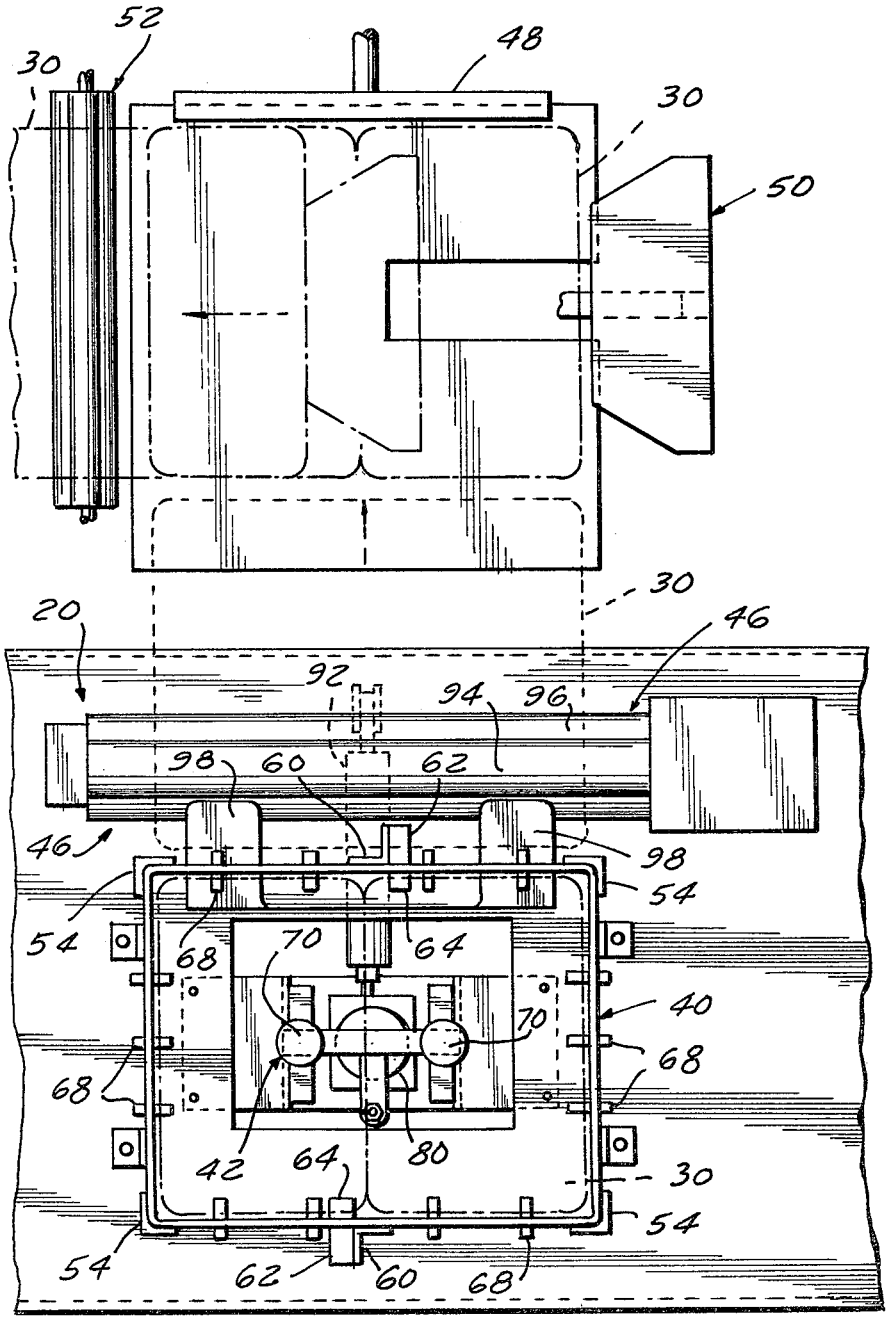
FIG. 3 is an enlarged fragmentary top plan view of the cardboard sheet dispenser.
Figure 4:
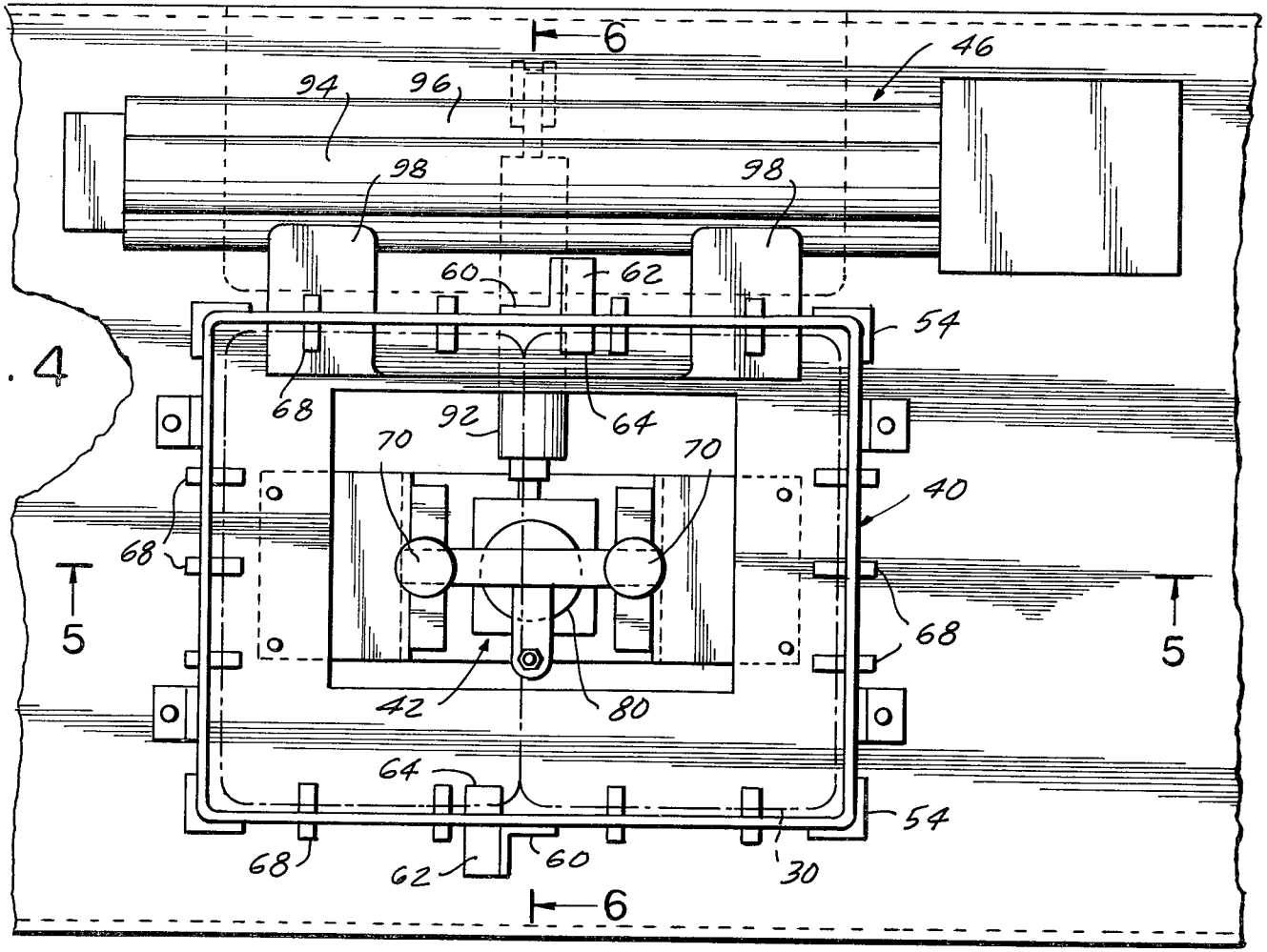
FIG. 4 is a further enlarged top plan view of the cardboard sheet hopper or magazine.

In the drawings, a cardboard sheet dispenser 20 is shown associated with a conveying system 22 leading from the discharge end of a slicing and measuring station 24. At this station bacon or bacon simulating pork product such as Sizzlean (marketed by Swift & Company, Chicago, Ill. 60604) or for that matter any other food product is sliced and segregated into batches 26 of shingled slices having a predetermined weight or measure. The conveying system 22 connects with the leading end of the packaging station 28 which may include the cardboard folding and creasing device of the type disclosed in commonly assigned application entitled CARD FOLDING AND CREASING DEVICE filed on even date herewith and assigned Ser. No. 143,491. Suffice it to say, at this juncture, the cardboard sheet dispenser 20 operates to associate the cardboard sheet 30 at the proper time in a timed and controlled manner with the segregated batch 26 of slices such that the batch 26 is deposited on the trailing part of the cardboard sheet 30 between the fold line 32 and the trailing end 34. Eventually the leading end of the cardboard sheet between the fold line 32 and the leading end 36 will be folded over the top of the batch 26 by the device of the above-referenced application. Thereafter, the forwarded cardboard sheet and batch will then be hermetically sealed in a plastic envelope in a manner well known to the art as well as the ultimate consumer.

With specific reference to the details of the cardboard sheet dispenser 20 a cardboard sheet hopper receives a plurality of stacked cardboard sheets 30, the lower cardboard sheet of which is adapted to be removed by a pick-off assembly 42 and transferred by this assembly to a feed roller assembly 46. This assembly 46, in turn, places a cardboard sheet 26 against an adjustable stop plate 48 where this cardboard sheet at the proper time, is adapted to be transferred by the pusher assembly 50 into the nip of the drive roller assembly 52 so that the cardboard sheet may receive thereon a batch 26 of the sliced product in timely fashion.

Referring to the hopper 40 four corner brackets 54 are supported vertically by an upper frame 56 and a base frame 58. A number of restrainer brackets 60 also extend between the upper frame 56 and the base frame 58 and in the disclosed embodiment there will be one restrainer bracket 60 at each end and two restrainer brackets along each side. Each restrainer bracket is provided with three spaced restrainers 62 having a downwardly and inwardly inclined face 64 as shown clearly in FIG. 6. The purpose of the restrainers 62 are not only to provide support of the vertically stacked cardboard sheets 30, but also to fan the cardboard sheets to prevent sticking of one to the other. At the base of the hopper appear a plurality of sawtooth strippers 68 which cooperate in supporting the stack of cardboard sheets 30 and complete the separation of cardboard sheets while providing assurance that only one cardboard sheet at a time will be removed from the base of the hopper 40.

Figure 5:
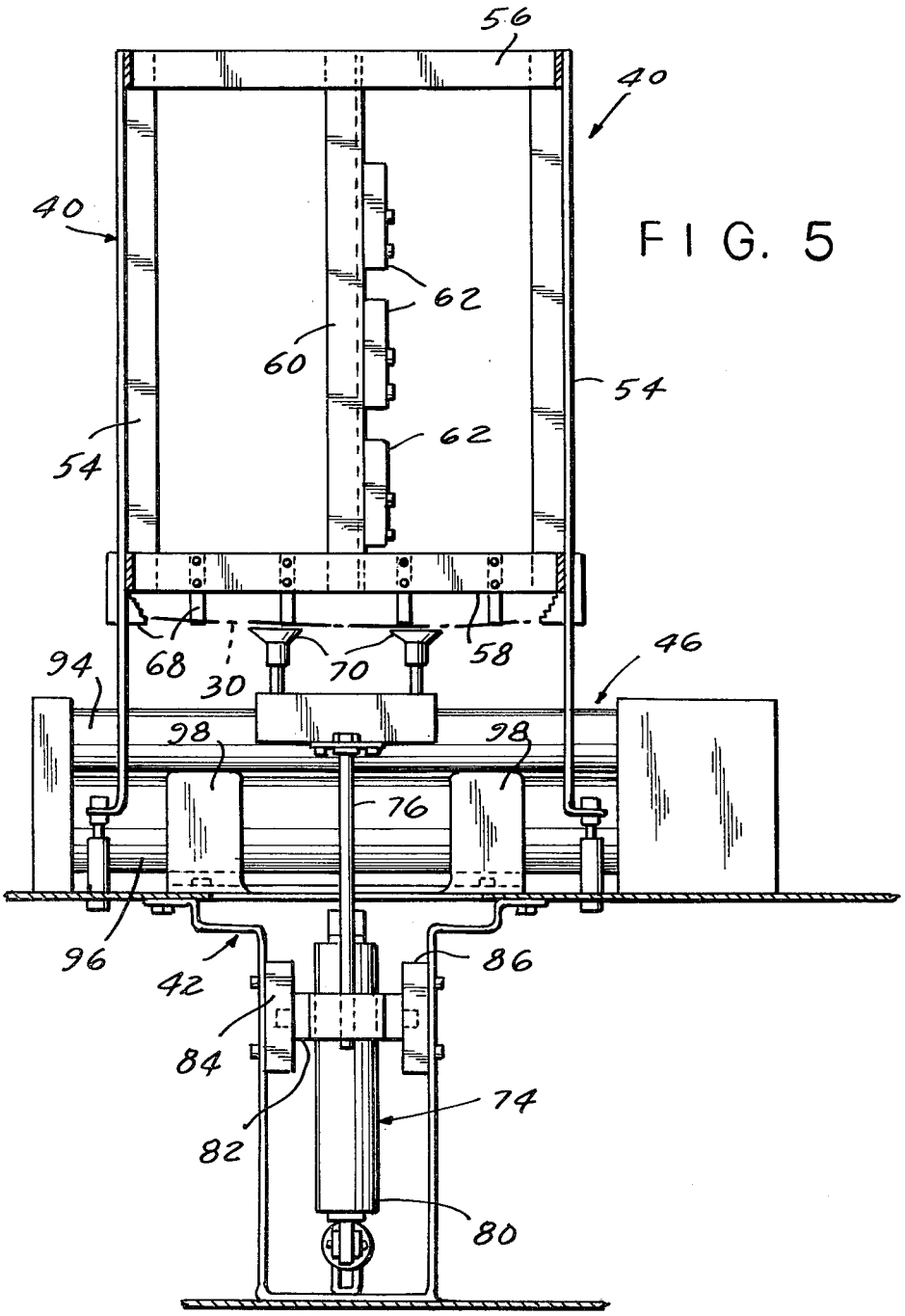
FIG. 5 is a sectional view taken along the line 5—5 of FIG. 4 with the cardboard sheet pick-off suction cups in a raised position.
Figure 6:
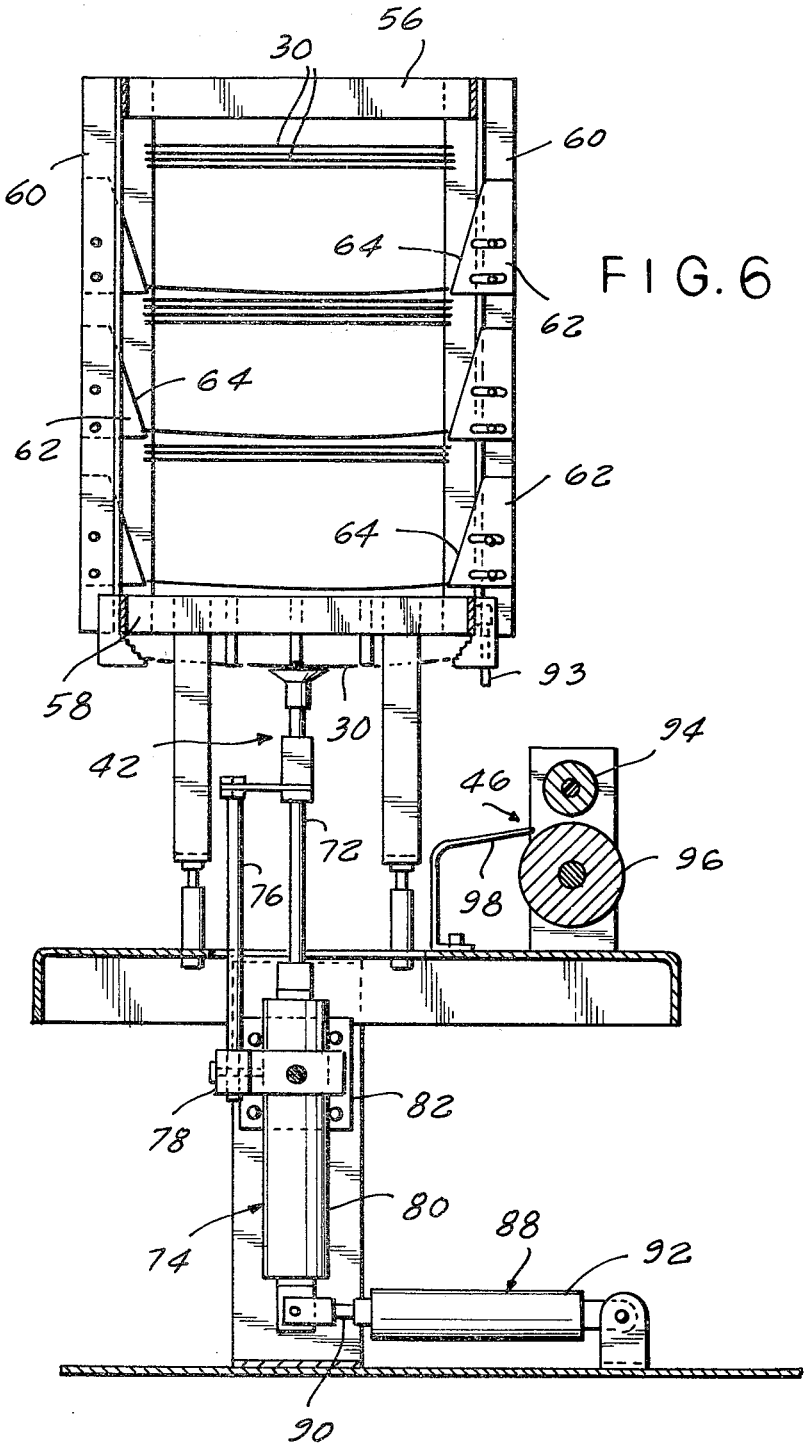
FIG. 6 is an enlarged sectional view taken along the lines 6—6 of FIG. 4 with the cardboard sheet pick-off suction cups in a raised position.
Figure 7:
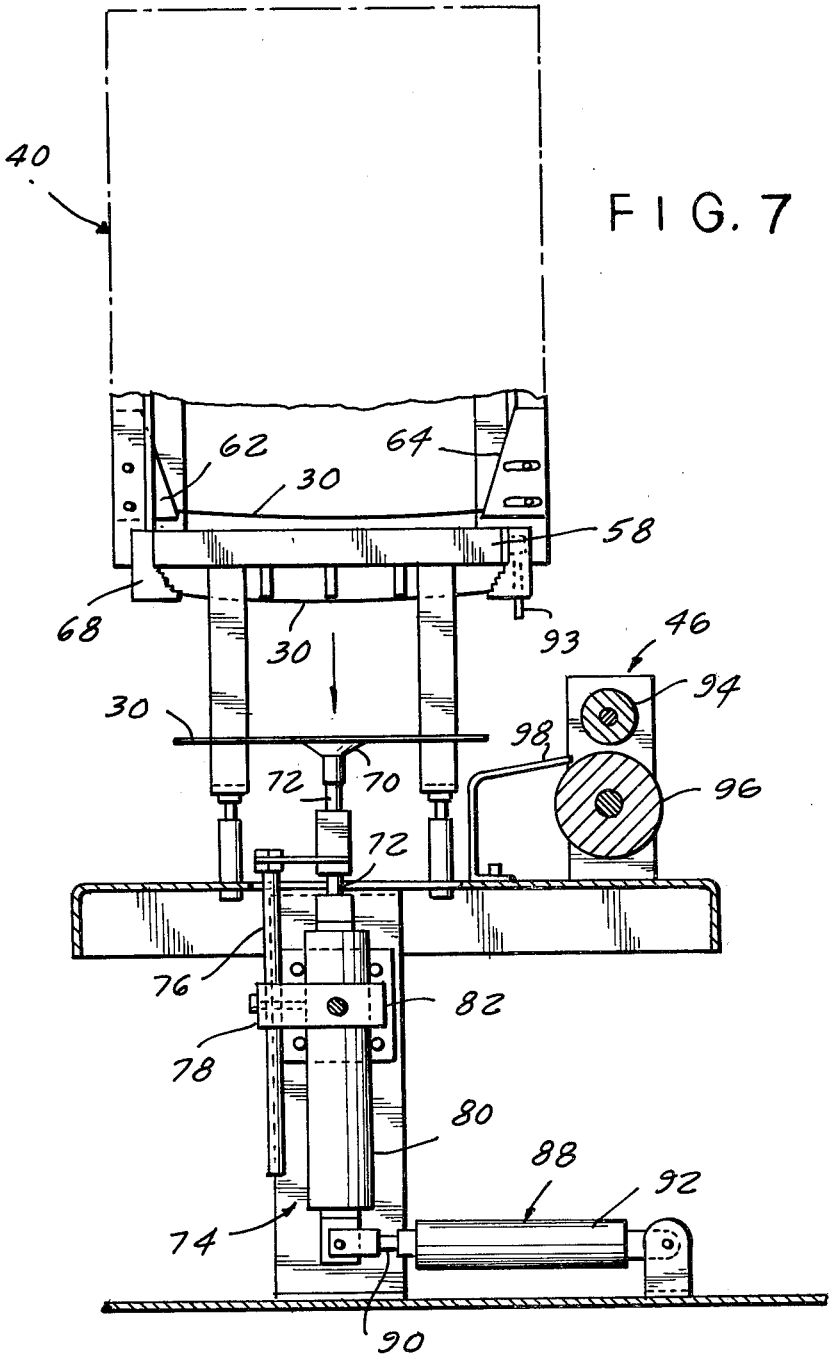
FIG. 7 is a view similar to FIG. 6, but with th cardboard sheet pick-off suction cups lowered with a cardboard sheet thereon.
Figure 8:
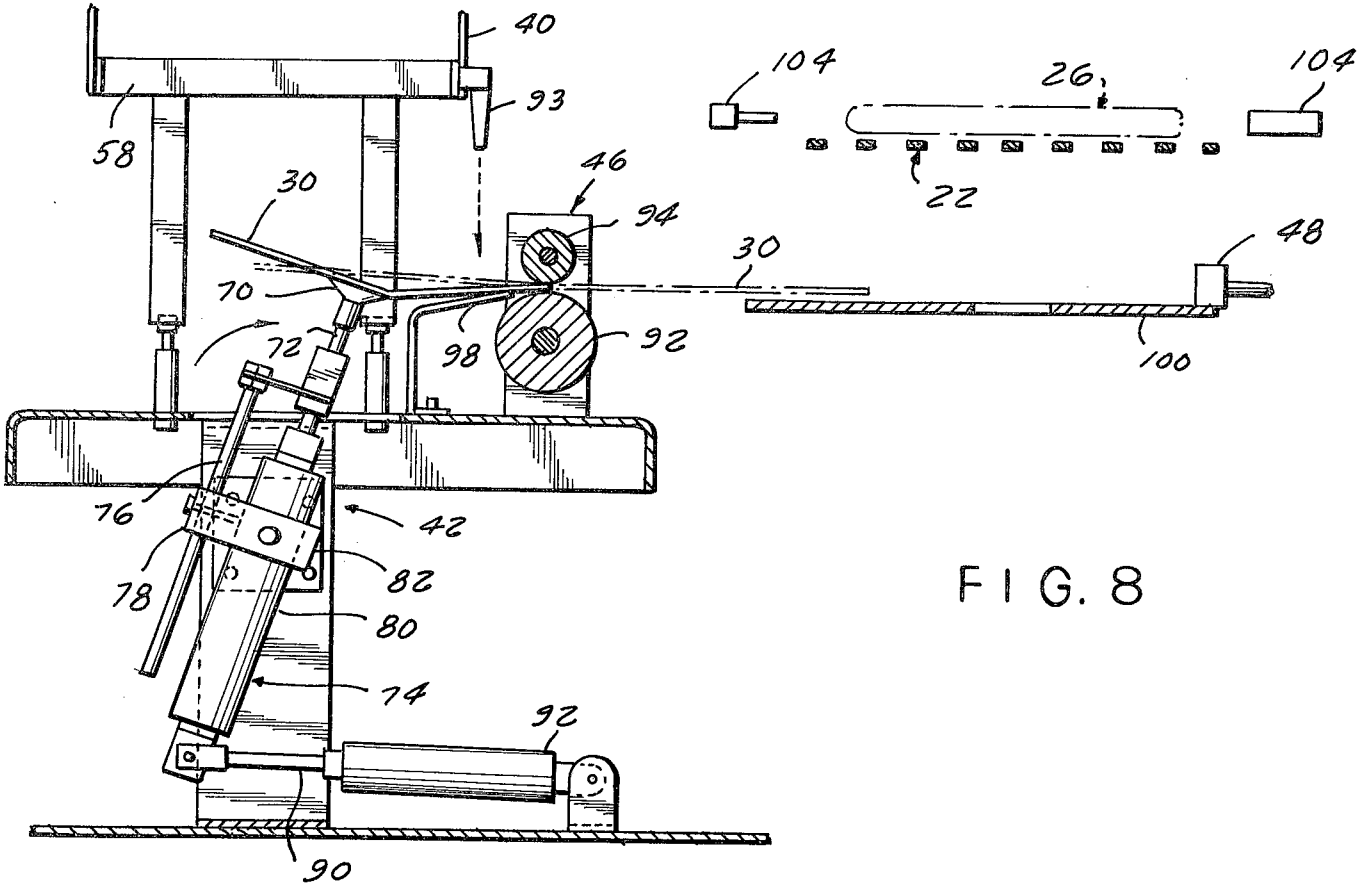
FIG. 8 is a view similar to FIG. 7 with the pickoff suction cups tilted to place the supported cardboard sheet in the nip of rollers which operate to transfer this supported cardboard sheet to a station at which the cardboard sheet may be transferred longitudinally into a further position at which it is capable of receiving the segregated batch of sliced bacon.
Figure 9:
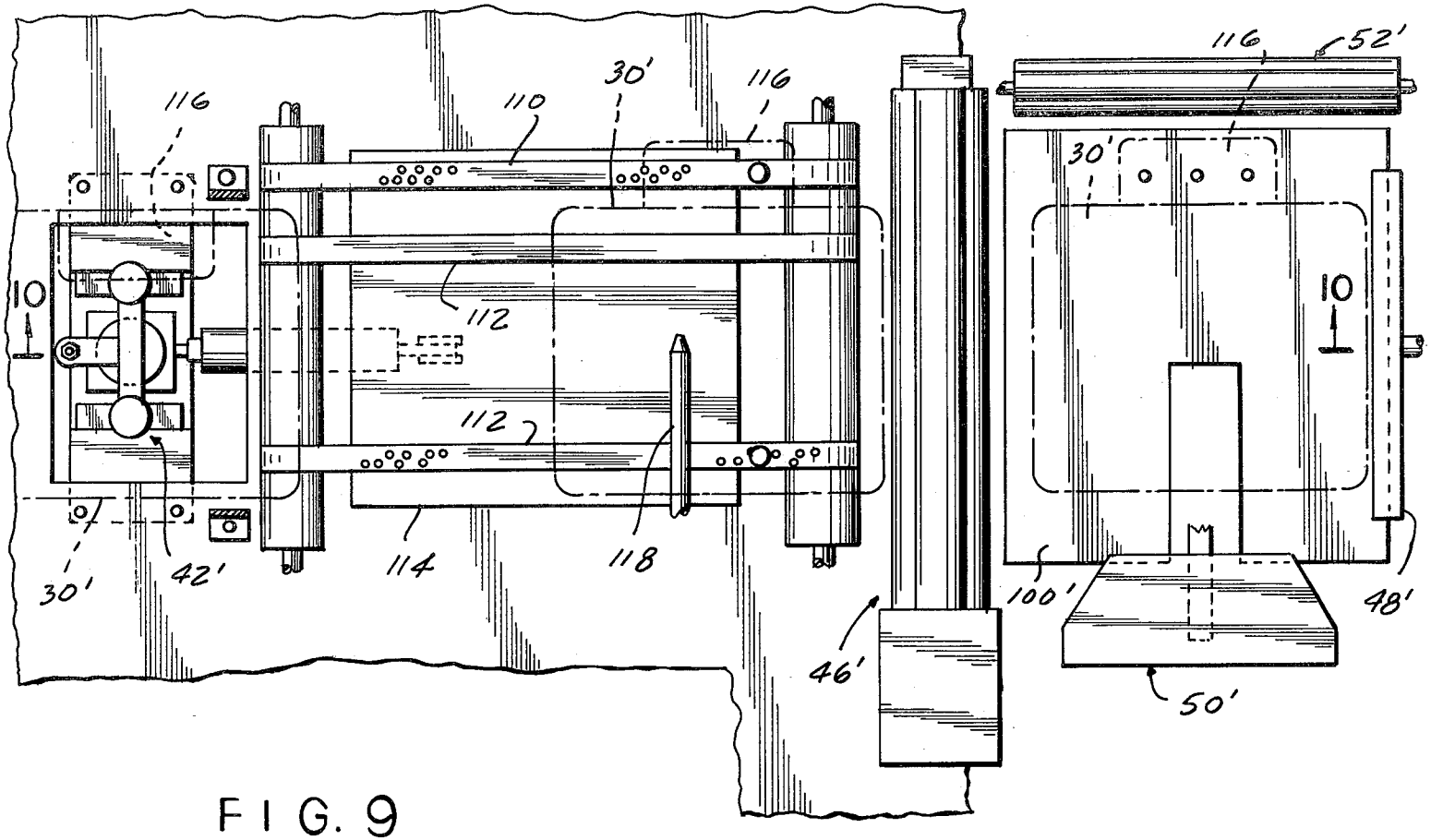
FIG. 9 is a fragmentary plan view of an alternative embodiment for transferring the cardboard sheet from the tilted pick-off for eventual association with the batch of sliced bacon.
Figure 10:
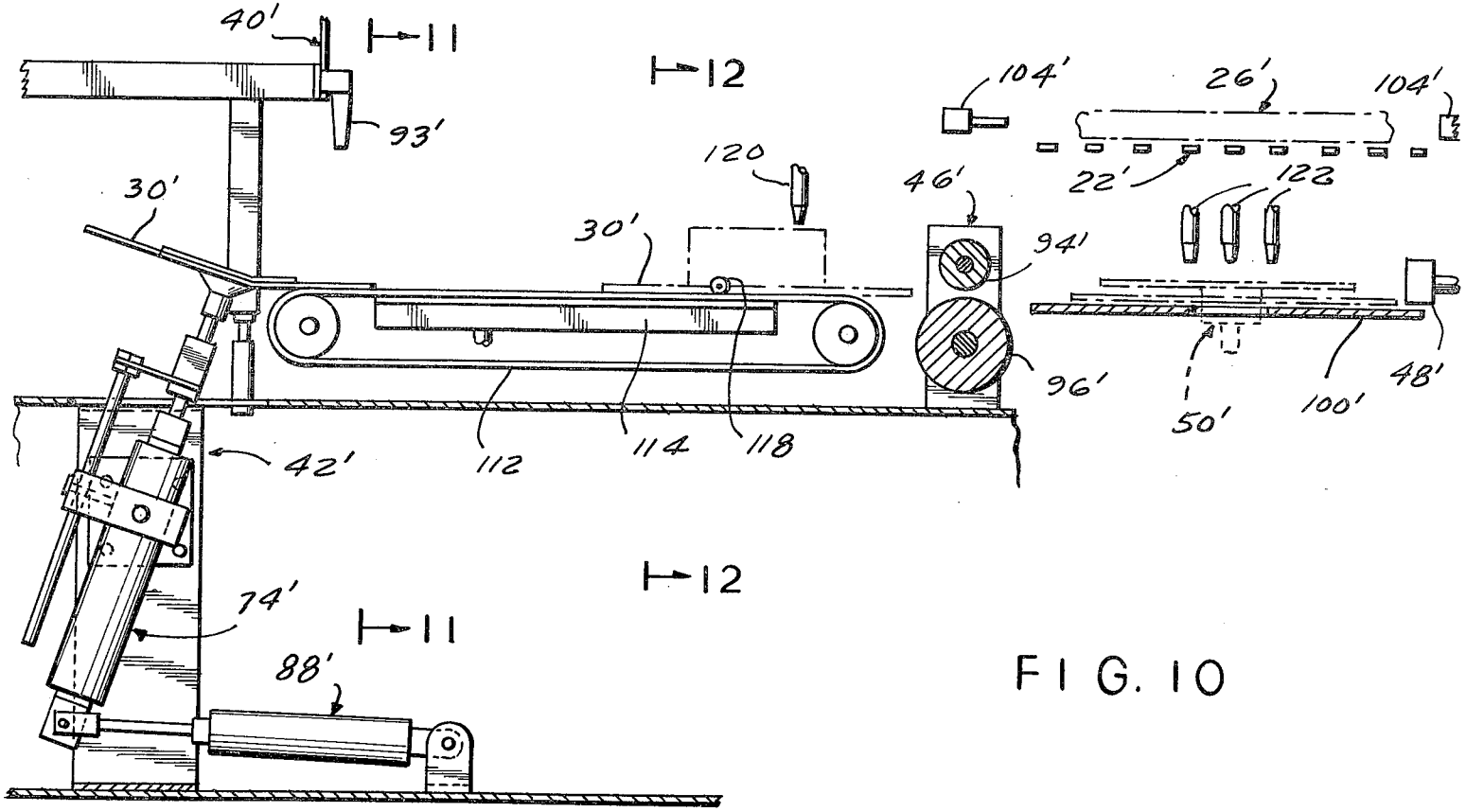
FIG. 10 is an elevational view taken along the line 10—10 of FIG. 9.
Figure 11:
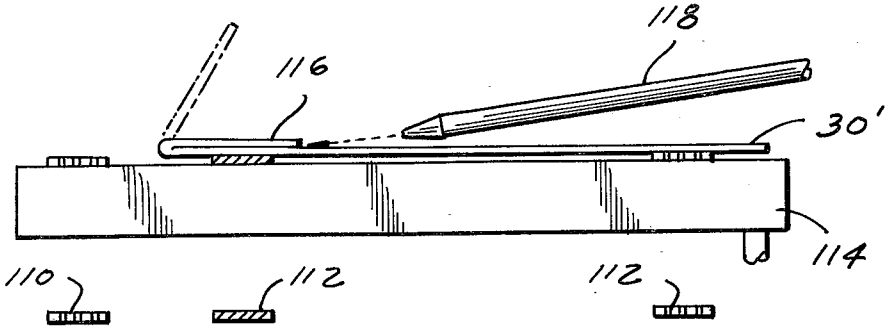
FIG. 11 is a sectional view taken along the line 11—11 of FIG. 10.
Figure 12:
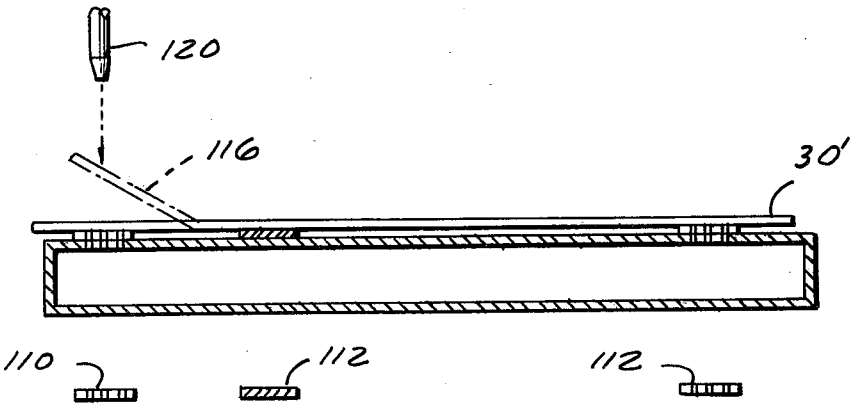
FIG. 12 is a sectional view taken along the line 12—12 of FIG. 10.

Reference is now made to the pick-off assembly 42 which includes a number of suction cups 70 supported by the piston 72 of the piston-cylinder assembly 74. A rod 76 secured to the piston is movable in bearing 78 secured to the cylinder 80 of the piston cylinder assembly 74. This rod operates to rigidify the piston 72 during the course of its reciprocal movement within the cylinder 80. The securement of the bearing 78 to the cylinder 80 is by means of a bracket 82 which in turn is pivotally mounted in bearings 84, thereby permitting the piston-cylinder assembly 74 to be pivotal from a vertically extending position as shown in FIGS. 5, 6 and 7 to an inclined position as shown in FIG. 8. This pivotal movement is obtained as a result of the actuation of a piston-cylinder assembly 88, the piston 90 of which is pivotally mounted at the base of the cylinder 80. When the piston 90 is retracted in the cylinder 92 of the piston-cylinder assembly 88 the piston-cylinder assembly 74 will be vertical, whereas, when the piston 82 is extended a predetermined extent the piston-cylinder assembly 74 will be tilted to the inclined position of FIG. 8. Thus, in its normal position, piston 72 will be extended so that cups 70 engage with the lowermost cardboard sheet 30 in the hopper 40. The suction within the cups 70 will cause the cups 70 to secure with the lowermost cardboard sheet 30 so that when the piston 72 is retracted within cylinder 80, the lowermost cardboard sheet 30 will be withdrawn below the serrated strippers 68 as shown in FIG. 7. Thereafter, the piston-cylinder 88 will be actuated to extend piston 90 thereby tilting the piston-cylinder assembly 74 as shown in FIG. 8 at which the lowered cardboard sheet 30 will be placed into the nip of the drive roller assembly 46.

The drive roller assembly 46 will receive the lowered cardboard sheet 30 in the nip of the drive and driven rollers 94 and 96. When this occurs, the suction in the cups 70 will be momentarily relieved to cause disattachment of the cup 70 with the cardboard sheet 30 transferred to the drive roller assembly 46. This piston-cylinder assembly 88 will retract its piston 90 to cause the piston-cylinder assembly 74 to assume a vertical position. Thereafter, the piston 72 will be extended so that its cups 70 will be forced into engagement with the lowermost cardboard sheet 30 then in the hopper 40. During this movement of the suction cups 70 from the tilted position of FIG. 8 to the extended position of FIG. 6, the suction will be reapplied so that the cups 70 will firmly secure with the lowermost cardboard sheet 30 in the hopper 40 to be ready for the start of the next card feeding cycle.

When the cardboard sheet 30 is transferred to the drive roller assembly 46 it will be initially placed on the platform 98 and as a result of the cooperation of the light air jet or blast from nozzle 93, the card will be properly placed between the nip of the rollers 94 and 96 and not fly away when the suction of the cups 70 is deactivated. When the cardboard sheet 30 is placed into the nip of the roller assembly 46 it will be transferred onto the platform 100 against the stop 48. The suction in the suction cup 70 will be turned on again following the transfer of the cardboard sheet 30 by the roller assembly 46 and during the return of the piston-cylinder assembly 74 to its upright or vertical position upon the retraction of the piston 90 of piston-cylinder assembly 88. When this occurs the piston-cylinder assembly 74 will be actuated to extend its piston 72 so that the suction cups 70 will be placed into engagement with the then lowermost cardboard sheet 30 in the hopper 40. The suction in the cups will render this engagement positive so that this card can be lowered and removed from the hopper 40 when a new cardboard sheet is required to be placed onto the platform 100.

As stated, the roller assembly 46 will transfer the engaged cardboard sheets 30 onto platform 100 and against the adjustable stop plate 48. Cardboard sheet 30 will remain in this position until it is moved into the nip of the roller assembly 52 as a result of the reciprocation of the pusher assembly 50. This assembly is shifted into engagement with cardboard sheet 30 to drive it forwardly into the roller assembly 52 as a result of the actuation of the piston-cylinder assembly 102 which is actuated when the electric eye 104 senses the presence of a batch 26 of sliced food product travelling on the conveying system 22. As explained previously, the batch 26 will be deposited on the rear part of the cardboard sheet 30 between the fold-line 32 and the trailing end 34. The pusher assembly 50 will be retracted to its starting position, which will then cause another cardboard sheet 30 to be lowered from the hopper 40 to the pick-off assembly 42 and transferred to the roller assembly 46 for placement on the platform 100.

Thus, a cardboard sheet 30 will always be present on platform 100 for movement forwardly by the pusher assembly 50 into the roller assembly 52 upon the detection of the batch 26 of sliced food product by the electric eye 104. Upon the retraction of the pusher assembly 50 the piston-cylinder assembly 74 will lower a new cardboard sheet 30 from the hopper 40 from the position illustrated in FIG. 6 to that illustrated in FIG. 7. Thereafter, the piston-cylinder assembly 88 will be actuated to tilt the piston-cylinder assembly 74 to place the cardboard sheet 30 onto the platform 98 under the influence of the air jet from nozzle 93. The roller assembly 46 will receive this cardboard sheet and place it on platform 100.

Referring now to FIGS. 9, 10, 11 and 12, wherein alternative embodiment is shown for transferring a modified cardboard sheet from the tilted piston-cylinder assembly 74 to the roller assembly 46 for eventual placement on the platform 100 against the stop 48. In connection with this embodiment like parts will be similarly numbered with an accompanying prime (′). In this embodiment, an interval of time is provided within which the lowered cardboard sheet 30 may have additional work performed thereon prior to replacement on the platform 100′ against the stop 48′ by the drive roller assembly 46′. In this connection, a vacuum or suction conveyor 110 may be advantageously interposed between the pick-off assembly 42′ and the drive roller assembly 46′. The suction conveyor 110 may include a plurality of tapes 112 and a convention suction box 114, which together with the conveyor 110 may only be on or activated when the pick-off assembly 42′ initiates and completes its cardboard sheet transfer cycle. In this embodiment, the cardboard sheet 30′ may be initially provided with a folded flap 116 which may be unfolded and placed in an extended position by the cooperation of a pair of air jets from nozzles 118 and 120 while travelling on the conveyor 110. The air jet or nozzle 118 will initate the unfolding process and jet 120 will hold the flap 116 in its extended position together with the suction supplied by the suction box 114 while the cardboard sheet 30′ is travelling on the conveyor 110. When the roller assembly 46′ transfers the cardboard sheet 30′ from the trailing end of suction conveyor 110 onto the platform 100′, a series of air jets from nozzles 122 cooperate in maintaining the panel 116 in its extended position on the platform prior to transfer by the pusher assembly 50′. The timing and duration of the air jets from nozzles 118, 120, 122 may be suitably synchronized with the movement of the pusher assembly 50′ and suction conveyor 110 to accomplish the intended unfolding and extension of the panel 116. This panel 116 may contain adhesive to cooperate in furthering the packaging of the batch of slices 26′ on or within the cardboard sheet 30′ or may simply be a panel that eventually is only folded over the product prior to the completion of the packaging operation.

It is also contemplated by the present invention that the pick-off assembly 42′ may be eliminated entirely and the suction conveyor 110 extended directly beneath the hopper 40′ in such a manner that the suction of the conveyor 100 when actuated will operate to draw from the hopper 40′, the lowermost cardboard sheet 30′ either downwardly or sideways through a gate for eventual transfer to the platform 100′.

Thus, the several aforenoted objects and advantages are most effectively attained. Although several somewhat preferred embodiments of the invention have been disclosed and described in detail herein, it should be understood that this invention is in no sense limited thereby and its scope is to be determined by that of the appended claims.

What is claimed is:

1. A cardboard sheet dispenser for use on a food product slicing machine line that groups the slices into segregated batches of predetermined measure, the dispenser being operable to dispense a sheet of cardboard from a storage area to a first location at which a batch of the slices are placed thereon, the cardboard sheet dispenser comprising:

a hopper for containing a plurality of vertically stacked cardboard sheets, the hopper including a base and a plurality of strippers at the base for cooperating in supporting the stack and cooperating in separating the cardboard sheets at the base to assure against sticking of the cardboard sheets to one another while permitting only one cardboard sheet at a time to be removed from the base of the hopper, the hopper including a top and being provided with restrainers intermediate the top and the base for cooperating in supporting the stack and to fan the cardboard sheets to prevent sticking of one to the other;

a pick-off assembly for removing the lowermost cardboard sheet from the hopper and transferring it to a second location; and conveying means for conveying the sheet at the second location to the first location at a predetermined time to permit the batch to be placed thereon.

2. The invention in accordance with claim 1, wherein the pick-off assembly includes a suction conveyor operable to remove a cardboard sheet from the hopper and transfer it to the second location.

3. The invention in accordance with claim 1, wherein the pick-off assembly includes a first piston-cylinder assembly assuming a normal vertically disposed position below the hopper and the assembly having at least one suction cup at the free end of the piston, the piston normally being in an extended position with the suction cup being engaged with and securing by suction the lowermost cardboard sheet in the hopper, upon actuation of the cylinder the piston is retracted in the cylinder to remove the lowermost cardboard sheet from the hopper to a lowered position at which it may be transferred to the second location.

4. The invention in accordance with claim 3, wherein means are provided for pivoting the first assembly to facilitate the transfer of the lowermost cardboard sheet to the second location, a drive roller assembly receives the lowered cardboard sheet from the suction cup of the inclined first assembly to complete the transfer of the sheet to the second position.

5. The invention in accordance with claim 3, wherein a second piston-cylinder assembly is disposed at an angle with respect to the first piston-cylinder assembly, the cylinder of the second assembly being pivotally mounted and the piston thereof being pivotally connected to the cylinder of the first assembly, pivotal means for pivotally mounting the first assembly, the piston of the second assembly being normally retracted to maintain the first assembly in a vertical position, upon actuation of the cylinder of the second assembly the piston thereof is extended to pivot the first assembly to an inclined position to facilitate the transfer of the lowermost cardboard sheet to the second location.

6. The invention in accordance with claim 5, wherein means are provided for actuating the second assembly to pivot the first assembly to its inclined position after the first assembly has been activated to lower a cardboard sheet to the lowermost position.

7. The invention in accordance with claim 6, wherein the second assembly is deactivated shortly after the first assembly is in its inclined position to return the first assembly to its vertical position following which the the piston of the first assembly is extended and its suction cup engages the lowermost cardboard sheet in the hopper.

8. The invention in accordance with claim 4, wherein the cardboard sheet includes a folded flap and a suction conveyor is interposed between the pick-off assembly and the drive roller assembly for conveying a cardboard sheet therebetween and unfolding means associated with the suction conveyor for unfolding the folded flap into an extended position.

9. The invention in accordance with claim 4, wherein the drive roller assembly includes a driven roll and a drive roll defining a nip therebetween, a platform at the entrance to the nip of the roller assembly for receiving a cardboard sheet thereon when the first assembly is in its inclined position and means for momentarily deactivating the suction in the cup when the cardboard sheet is placed on the platform.

10. The invention in accordance with claim 9, wherein an air jet means directs a jet of air downwardly upon the cardboard sheet placed on the platform to prevent the cardboard sheet from flying and assure that it is placed in the nip of the roller assembly.

11. The invention in accordance with claim 8, wherein the unfolding means includes an air jet directed against the free end of the flap for initiating the unfolding of the flap and a second air jet directed downardly to complete the unfolding of the flap and maintain it substantially flat against the suction conveyor.

12. The invention in accordance with claim 11, wherein a further downwardly directed air jet is associated with the conveying means to hold the flap in an unfolded condition while on the conveying means.

* * * * *